United States Patent [19]

Bader

[11] Patent Number: 4,832,679

[45] Date of Patent: May 23, 1989

[54] ROTOR FOR CENTRIFUGE

[75] Inventor: Peter Bader, Hamburg, Fed. Rep. of Germany

[73] Assignee: Firma Eppendorf-Netheler-Hinz GmbH, Hamburg, Fed. Rep. of Germany

[21] Appl. No.: 209,495

[22] Filed: Jun. 20, 1988

[30] Foreign Application Priority Data

Jun. 20, 1987 [EP] European Pat. Off. ..... 87108855

[51] Int. Cl.[4] ..... B04B 5/02

[52] U.S. Cl. ..... 494/16; 494/31

[58] Field of Search ..... 494/16, 17, 18, 19, 494/20, 21, 12, 14, 31, 33, 34; 422/72, 102; 210/781, 782

[56] References Cited

U.S. PATENT DOCUMENTS 3,825,178 7/1974 Burg ..... 494/16
4,221,325 9/1980 Kubota ..... 494/16 X
4,412,830 11/1983 Strain et al. ..... 494/12
4,484,906 11/1984 Strain ..... 494/16
4,553,955 11/1985 Lam et al. ..... 494/16
4,778,442 10/1988 Gordon ..... 494/16

*Primary Examiner*—Timothy F. Simone
*Attorney, Agent, or Firm*—Toren, McGeady & Associates

[57] ABSTRACT

A rotor for a centrifuge comprises a bottom part and a top part. The top part is formed with openings for receiving test tubes in rim engagement. The bottom part has an upwardly deformed outer rim, which constitutes a collecting trough. The test tubes are particularly indirectly inserted into the openings (3 to 5) and are biased by spring means (21), which engage the particularly indirectly inserted test tubes from the inside and urges them outwardly against a frustoconical wall (10) of the top part. For an indirect insertion of the test tubes, they may be inserted into guide inserts (6, 7) which consist of cylindrical bushings and are urged outwardly.

11 Claims, 2 Drawing Sheets

ROTOR FOR CENTRIFUGE

BACKGROUND OF THE INVENTION

1. Field of the Invention

This invention relates to a rotor for a centrifuge, comprising bottom and top parts, which are formed with openings for receiving test tubes in rim engagement, wherein the bottom part is provided with a collecting trough which is constituted by an upwardly extending outer rim.

2. Description of the Prior Art

Such a rotor for a centrifuge is known from German Patent Specification 36 01 789. In the known design the bottom part has downwardly and outwardly extending receptacles for the test tubes. The receptacles are upwardly open and are also laterally open in an upward and outward direction so that the test tubes can be inserted into the receptacles from the outside in a lateral direction when the rotor is open and the test tubes are laterally guided. These lateral openings can be covered by the top part in that surface which contains the most outwardly disposed wall portion of the test tubes. The top part also covers the test tubes at their top end and also covers the bottom part.

Whereas that design affords certain advantages, the fact that the rotor consists of only two parts requires the test tubes to be inserted and held transversely to their longitudinal direction so that the two part has only a safety function. The top and bottom parts must be made to exactly fit each other and for this reason must be milled in time-consuming and expensive operations.

At operating speeds of an order up to 15,000 r.p.m., the interengaging sealing rims of the top and bottom parts will be subjected to considerable loads. The distribution of the support of the test tubes to the bottom and top parts results in uncertainties.

Published German Application 33 43 846 discloses for a centrifuge a rotor which has also laterally open receptacles for test tubes. But said receptacles are formed in a tripartite rotor having an insert in which the receptacles are open in a downwardly inclined direction and are adapted to be closed by a bottom part into which the insert can be inserted. The insert is held on the outside by a top part, which has a correspondingly inclined wall portion. That design is not only expensive but involves a difficult handling in use because the insert constitutes an intermediate or receiving part and is formed with the receptacles for the test tubes and must be held in an inverted position until the test tubes have been inserted. The test tubes can then be held in position in that the bottom part is applied from above. Thereafter the parts are inverted and inserted into the top part.

Published German Application 33 34 655 discloses a tripartite rotor comprising a bottom part, a tube-holding part and a top part. These three parts are all mounted on a drive shaft. The tube-holding part has an inwardly tapering, conical rim portion that is formed with receiving openings and at the rims of said openings is engaged by outwardly extending supporting rims of the test tubes. The tube-holding part has an outwardly inclined wall, which is so arranged and directed relative to the receiving openings that an intermediate portion of each test tube which has been inserted and which initially depends will engage that wall when the rotor is rotating at operational speeds.

The resulting subassembly is covered and held together by a top part which has been applied.

The bottom part comprises a collecting trough, which consists of an upwardly and inwardly deformed rim of the bottom part. The trough is covered by the rim of the tub-holding part. For this reason it is doubtful whether that collecting trough can fulfill its intended function because a breathing may occur between a lower rim flange of the tub-holding part and the collecting trough of the bottom part and may have the result that the contents of defective test tubes may be thrown out. Although the test tubes bear outwardly on the tube-holding part at and above a certain centrifuging speed, that contact is not uniformly effected but will depend on the volume of the contents of each test tube so that the test tubes may initially perform a pendulum motion and may rebound. This will impose a load on the rotor and requires the test tubes to be closed at their top by a cover to ensure that the contents cannot be thrown out. Problems are also be involved in the mounting and fixation of such cover because the test tubes are not firmly held in their receptacles.

GB A 2,098,516 discloses an integral rotor for a centrifuge, which rotor is provided with a detachable cover. The bottom part of the rotor is formed with the openings for receiving the rims of the test tubes and has an inturned bottom rim, which constitutes a collecting trough. That rotor constitutes a narrow double cone, which cannot easily be cleaned. Besides, the test tubes are held in the openings only at the top rim flanges of the tubes so that the latter are not reliably held in position. The walls of the test tubes cannot engage the outside surface of the bottom part so that the test tubes will swing in operation.

In the rotor disclosed in German Patent Specification 36 01 789 and GB A 2,098,516 the bottom part comprises a frustoconical wall portion for receiving the test tubes. In accordance with Published German Application 33 34 655 such wall portion is formed in an intermediate part.

SUMMARY OF THE INVENTION

It is an object of the invention to provide for a centrifuge a rotor which consists of two housing parts and which is of the kind described first hereinbefore and can conveniently be handled and easily be cleaned and which is designed to essentially improve the holding of test tubes when the rotor is stationary and when it rotates at very high speeds and even at changing speeds so that a higher safety is ensured by the rotor even though it comprises only two housing parts.

In a rotor for a centrifuge, which rotor has a top part having a frustoconical wall portion and is formed with openings for receiving inserted elements having top rim flanges bearing on the outside of said wall portion around said openings, that object is accomplished in that said openings are adapted to receive test tubes which are particularly indirectly held in said openings and which for an indirect holding are provided with inserts for guiding the test tubes, and spring means are provided, which bear from the inside on the test tubes, which are particularly indirectly held, or on the guide inserts, and urges them outwardly against the frustoconical wall portion of the top part.

The guide inserts are used particularly for an operation at higher speeds in excess of 12,000 r.p.m. and ensure that the test tubes preferably made of plastic will be relieved.

In the design which has been described the top part, which is known per se, provides surfaces which are engageable by the elements which are inserted into said top part and which may consist of guide insert or test tubes. Said top part is engageable around the openings by the top rim flanges of the inserted elements and the downwardly flaring conical wall portion of the top part is engageable by the side walls of said inserted elements, which are directionally stabilized by the spring means so that a reliable holding and directional stability of the inserted elements will be ensured when the rotor is at a standstill and when it is rotating at very high speed.

The guide inserts suitably consist of cylindrical bushings, which are open at their top and bottom ends.

The spring means prevent a rattling of the guide inserts or test tubes when the rotor is at a standstill and also prevent an unintended slipping of the guide inserts out of the openings together with the test tubes when the latter are removed and prevent the guide inserts from falling out when the rotor is improperly handles. On the other hand, the spring means ensure that any bushing which has been soiled or damaged can easily be replaced by the user when he has disassembled the rotor. In a particularly preferred arrangement, the guide inserts consist of cylindrical bushings which have been inserted into the openings and comprise as a top abutment an outturned rim flange and are open at the bottom and terminate at a distance from the bottom part of the rotor. The spring means bear on the guide inserts from the inside. Owing to that arrangement the guide inserts are held in a predetermined position and tolerances will be compensated. Because the guide inserts are open-bottomed, there will be no vibrating columns of air so that there is no need for a covering at the top and the spring means will reliably hold the inserted test tubes in position regardless of the extent to which the test tubes are filled.

Such a vibrating column of air cannot be formed in an open-bottomed cylindrical guide insert or will be damped therein. In a preferred arrangement there is a peripheral annular gap between the top and bottom parts and said gap provides a passage for an entrance of air for effectively cooling the guide inserts and test tubes and serves also to compensate any tolerances. The gap will contribute to the suppression of air columns and of the corresponding noise at individual parts. Besides, the gap permits the top and bottom parts to be taken apart and cleaned easily.

The described ingress of air will be particularly desirable in cooling centrifuges because the air flowing through said gap will ensure that the individual guide insert bushings and test tubes will be cooled more effectively than is possible in known arrangements.

In a particularly preferred embodiment the rotor for a centrifuge comprises integral spring means, which consist of a plurality of segments and by which inherently loosely held guide inserts or test tubes are urged outwardly so that their side walls engage the wall of the conical top part. Owing to the division of the spring means into segments, forces of equal magnitude will be exerted on each guide insert or each test tube.

In the rotor comprising bottom and top parts the spring means suitably consist of a disk, which is held between said parts and is formed with slots, which extend inwardly from the periphery of the disk and define spring leaves. A spring having that design will be particularly desirable for a rotor for a centrifuge also because the spring divided into segments is fixed in the peripheral direction to said top and bottom parts.

In accordance with another desirable feature each spring leaf has an outer end portion which bears on a guide insert to force the latter outwardly against the top part. The outer edge portion of each spring leaf may be formed with a concave recess conforming to a cylindrical guide insert.

In accordance with a further feature the outer edge of the spring means and particularly of each spring leaf is angled to form a conical edge flange, which is adapted to bear on the guide insert in surface engagement therewith. As a result, the force of the spring will be exerted on the test tubes or on the preferably cylindrical guide inserts over relatively large areas so that a deformation or an abrasion or wear will be avoided.

The downwardly flaring conical wall of the top part may expand to some extent under centrifugal force and that expansion may be allowed for by the gap. In that case the operation at the required speed will have the result that particularly the guide inserts will bear on the outer wall.

In accordance with a desirable feature there is no contact between the bottom part and any guide insert or any test tube under any operating condition so that a deformation of the collecting trough will substantially be avoided.

The spring means consisting of a spring disk are suitably secured to a hub of the rotor between a mounting flange of said hub and flangelike wall portion of the top or bottom part, preferably of the bottom part, because in that case the spring means are fixed at a location which is spaced a larger distance from the openings for receiving the cylindrical guide inserts or test tubes.

DETAILED DESCRIPTION OF THE PREFERRED EMBODIMENT

Figure 1:
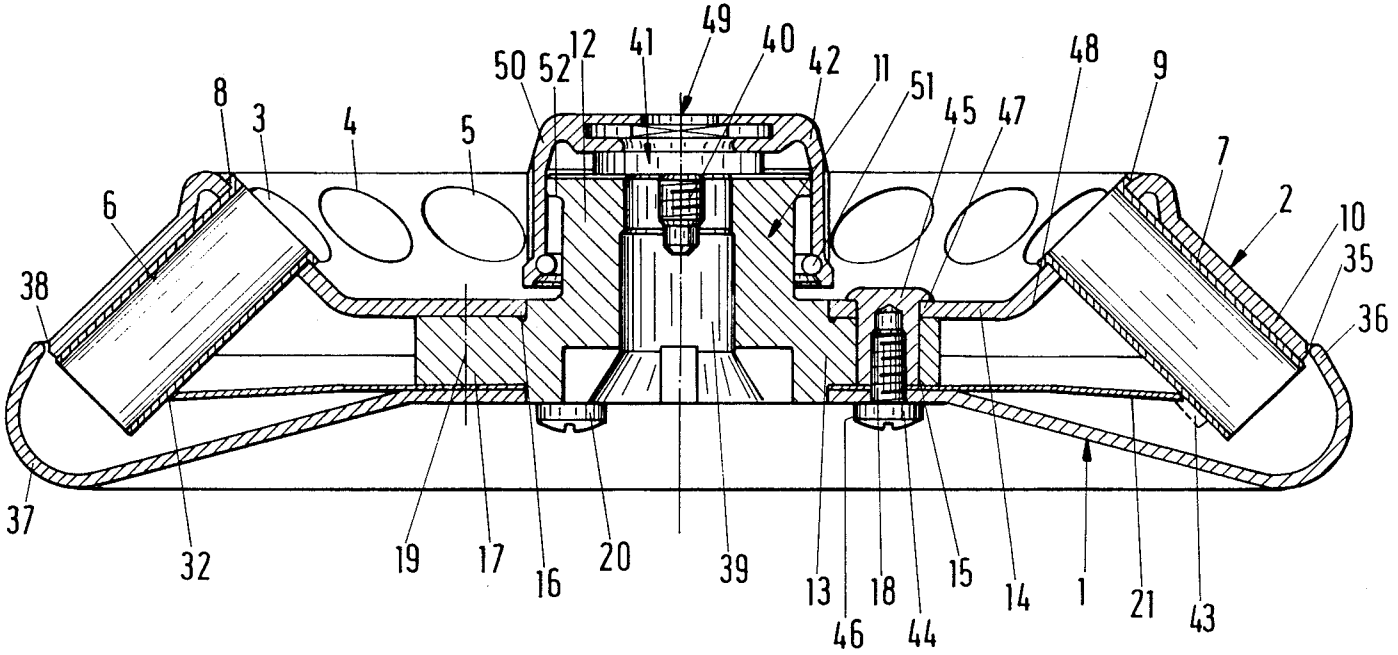
FIG. 1 is a vertical diametral sectional view showing a rotor for a centrifuge and FIG. 2 is a top plan view showing the spring disk of the rotor.

An illustrative embodiment of the invention will now be described in detail with reference to the drawing.

The rotor for a centrifuge comprises a bottom part 1 and a top part 2. The latter is formed with openings 3, 4, 5 ... for receiving test tubes or guide inserts 6, 7 for receiving such test tubes. Each guide insert or test tube has at its top end an outturned rim flange 8 or 9, which bears on the outside surface of the top part around the associated one of the openings 3, 4, 5 ... . The top part comprises a downwardly flaring conical wall portion 10, which is engageable by the side walls of the guide inserts or test tubes which have been inserted into the openings 3, 4, 5 ... .

The wall portion 10 is connected by an upwardly convex bend 9 to an inwardly and downwardly flaring, conical wall portion 48, which is formed with the openings 3, 4, 5 ..., which have axes intersecting on the center line 49 of the rotor. The wall portion 48 is continued by a flangelike wall portion 14, which is at right angles to the center line 49 of the rotor.

The top and bottom parts are combined in a unit with a hub 11, which has a cylindrical part 12 and at the lower end thereof has an outwardly directed mounting flange 13. The flangelime wall portion 14 of the top part 2 is secured to the top surface of the mounting flange 13.

A corresponding flangelike wall portion 15 of the bottom part 1 is secured to the bottom surface of the mounting flange 13, which is formed on said top and bottom surfaces with offset surfaces 16, 17 defined by steps having a height which corresponds to the wall thickness of the associated wall portion 14 or 15. The flangelike wall portions 14 and 15 are formed with screw holes which contain fixing screw means, which preferably consist of three angularly spaced apart fixing screw assemblies 18, 19 and 20.

Each of the fixing screw assemblies 18, 19, and 20 comprises, as is shown for the assemblies 18 and 20, a fixing screw 44 and a cap nut 45. The screw 44 extends through a hole 46 in the flange 15. The cap nut 45 extends through an opening 47 in the flange 14.

Figure 2:
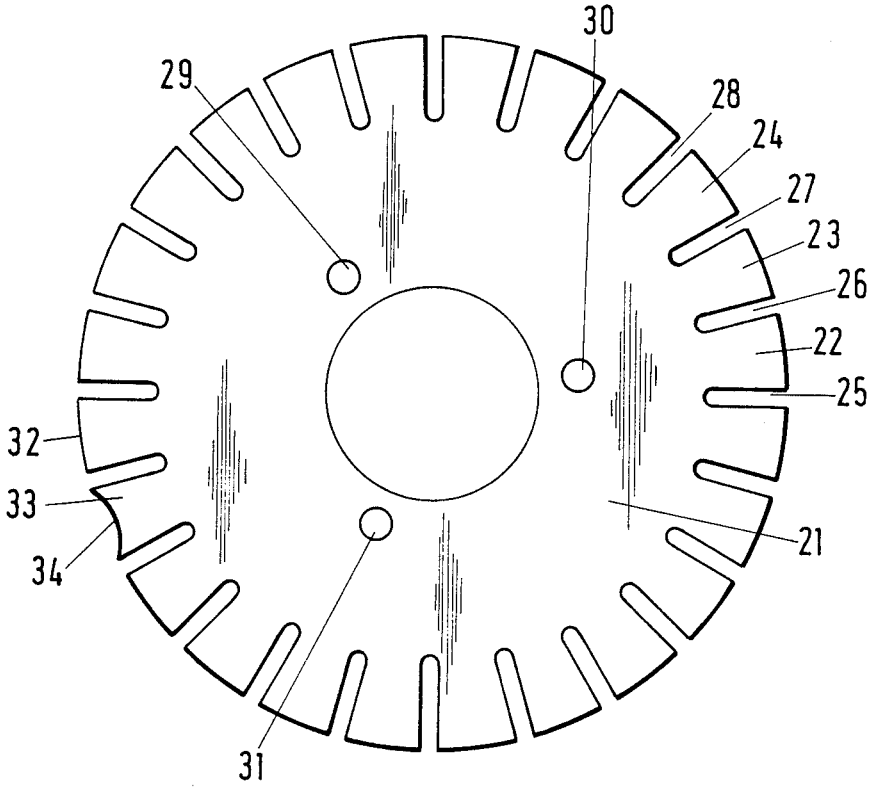

Spring means consisting of a spring disk 21 are disposed between and secured to the mounting flange 13 and the edge flange 15 of the bottom part 1. That spring disk is shown in a top plan view in FIG. 2. The spring disk 21 is formed with radial slots 25, 26, 27, 28, which are open at the periphery of the disk 21 and define spring leaves 22, 23, 24 ..., which are equally angularly spaced.

The spring disk 21 is fixed by the fixing screw means 18 to 20, which extend through holes 29 to 31 formed in the spring disk 21 and hold the latter in such an orientation that each of the spring leaves 22, 23, 24 ... bears on the outside surface of one of the test tubes or cylindrical guide extension and regardless of the speed of the rotor holds the side wall of said test tube or guide insert in engagement with the downwardly flaring conical wall 10 so that the rim flanges 8, 9 will be relieved and the test tubes are stabilized and need not be covered at the top.

If cylindrical guide inserts 6, 7 are not provided and test tubes are directly inserted into the openings 3, 4, 5 ... , they will be engaged by the spring disk 21, particularly by the outer edges of the spring leaves 22, 23, 24 ... which forces the test tubes radially outwardly so that their side walls are held in engagement with the wall 10. The outer edges 32 of the spring leaves may have conical surfaces corresponding to the conicity of the wall 10 or may be rounded. As is shown for the edge 33 of the one spring leaf said outer edges extend along an inwardly concave line 34 to conform to the cylindrical guide inserts or to the test tubes, which in that case will also be retained in a peripheral direction.

As is indicated in dotted lines on the right in FIG. 1, the outer end of each of the spring leaves 22, 23, 24 ... may be angled to form an edge flange 43, which is curved to conform to the cylindrical guide insert 7 in surface contact therewith. A similar shape may be given to the edge 32 in FIG. 1 and to the other spring leaves in a special embodiment.

A desirable feature of the illustrated design resides in that a peripheral annular gap 35 is left between the top part 2 and the bottom part 1 on the outside. The gap 35 is defined at its bottom by the stepped top edge 36 of the bottom part 1. Adjacent to that top edge 36, the bottom part 1 has been deformed to constitute a collecting trough 37 below the cylindrical guide inserts or test tubes. The gap 35 is defined at its top by the bottom edge 38 of the top part 2, specifically by the bottom rim of the conical wall portion 10, which is engaged by the side walls of the test tubes or guide inserts. That bottom rim 38 may be bevelled to extend substantially to the axis of the hub 11.

The bottom edge of the top part extends sufficiently below the top edge of the bottom part so that particles which are directly accelerated by centrifugal force cannot escape through the gap 35.

The air passage which is constituted by the gap 35 will suppress any noises. The bottom part having the illustrated design can easily be detached and can easily be cleaned or replaced. The guide inserts 6, 7 or any test tubes which have directly been inserted will not contact the bottom part so that the rising outer wall portion will not be loaded by the inserted test tubes.

The spring disc will ensure that the cylindrical guide inserts or test tubes will reliably be held in their operative position in the top part as long as the spring disk 21 is held on the offset surface 17.

The hub 11 has a downwardly open central opening 39, which is adapted to receive a stub shaft, not shown, of a drive for the rotor. The stub shaft has at its top a tapped opening, into which a screw-threaded shank 40 of a fixing screw 41 can be screwed. The fixing screw 41 has a head 42, which is guided and captively held on the top end face of the hub 11 but is rotatable and vertically movable relative to the hub 11.

The head 42 is formed with the profile that is indicated in section in FIG. 1 and is covered by a cap 50, which at its lower end is provided with inwardly protruding detent means consisting, e.g., of a resiliently inserted snap ring 51. For captively retaining the fixing screw 41, that detent means may bear on an outwardly extending flange 52 formed on the cylindrical part 12 of the hub 11.

I claim:

1. In a rotor for a centrifuge, which rotor comprises a bottom part and a top part, wherein said top part has a downwardly flaring, conical wall portion and is formed with openings, which are adapted to receive respective insertable elements selected from the group consisting of test tubes and guide inserts, which insertable elements have at their top end an opening surrounded by an outwardly extending flange (8, 9), which is adapted to engage said top part on its outside surface around the associated opening, and wherein said bottom part has an outer rim which extends upwardly to form a collecting trough, the improvement residing in that spring means (21) are provided for bearing on radially inwardly facing outside surfaces of said insertable elements so as to urge said insertable elements outwardly against said downwardly flaring conical wall portion (10) of said top part (2).

2. The improvement set forth in claim 1, wherein said inserted elements consist of open-bottomed guide inserts (6, 7), which terminate at a distance from the bottom part and are adapted to receive test tubes, and said spring means (21) bear on the radially inwardly facing outside surfaces of said guide inserts (6, 7).

3. The improvement set forth in claim 1, wherein said top and bottom parts (2, 1) define at their outside periphery an annular peripheral gap (35) for an ingress of air for cooling said insertable elements which gap also serves to compensate dimensional tolerances of said top and bottom parts.

4. The improvement set forth in claim 1, wherein said spring means (21) have angled conical edge flange means (43) for bearing on said insertable elements (6, 7) in surface contact therewith.

5. The improvement set forth in claim 1, wherein said spring means (21) are integral and divided into segments and said insertable elements (6, 7) are adapted to be loosely inserted into said openings and to be urged radially outwardly by said spring means into engagement with said downwardly flaring conical wall portion (10) of said top part (2).

6. The improvement set forth in claim 5, wherein said spring means comprise an apertured spring disk (21), which is held between the bottom part (1) and the top part (2) by clamping means with intermediate elements interposed, and said spring disk is formed with radial slots (25 to 28), which are open at the periphery of the disk (21) and define spring leaves (22 to 24).

7. The improvement set forth in claim 6, wherein each spring leaf (22 to 24) has a radially outer edge portion (32) for bearing on one of said insertable elements.

8. The improvement set forth in claim 7, wherein the outer edge (33) of each spring leaf has a concave recess (34) and said insertable elements are cylindrical and conform to said concave recess.

9. The improvement set forth in claim 6, wherein each of said spring leaves (22 to 24) has at its outer end an angled conical flange (43) for bearing on one of the insertable elements (6, 7) in surface contact therewith.

10. The improvement set forth in claim 6, wherein each of said top and bottom parts (2, 1) has a flangelike wall portion (14, 15), said rotor comprises a hub (11), which is disposed between said top part (2) and said bottom part (1), said hub (11) comprises a mounting flange (13), said spring disk (21) extends between said mounting flange (13) and one of said flangelike wall portions (14, 15), and fixing means (18, 19, 20) extending through said spring disk (21) are provided for fixing said flangelike wall portions (14, 15) and said spring disk (21) to said mounting flange (13).

11. The improvement set forth in claim 5, wherein all said inserted elements are spaced from said bottom part (1) under any operating condition of the rotor.

* * * * *